United States Patent [19]

Sims

[11] 4,220,079

[45] Sep. 2, 1980

[54] RETENTION OF TAGS FOR FOOD AND BEVERAGE PREPARATION BAGS

[76] Inventor: Ernest G. Sims, 31 Whippoorwill Way, Belle Mead, N.J. 08502

[21] Appl. No.: 972,044

[22] Filed: Dec. 21, 1978

Related U.S. Application Data

[63] Continuation-in-part of Ser. No. 957,760, Nov. 6, 1978, abandoned.

[51] Int. Cl.[2] ..... A47G 19/22; A47G 19/20; A47J 31/00

[52] U.S. Cl. ..... 99/295; 206/0.5

[58] Field of Search ..... 220/85 R, 404, 23.83; 206/0.5; 99/295

[56] References Cited

U.S. PATENT DOCUMENTS

| | | | |
|---|---|---|---|
| 2,328,599 | 9/1943 | Armstrong | 99/295 |
| 2,334,533 | 11/1943 | Armstrong | 99/295 |
| 4,027,774 | 6/1977 | Cote | 220/404 |

*Primary Examiner*—George E. Lowrance
*Attorney, Agent, or Firm*—George E. Kersey

[57] ABSTRACT

Method and apparatus for retaining the tags of food and beverage preparation bags, such as tea bags, by positioning each tag on the outside of a container in which the bag is needed. The string connecting each bag with its associated tag is retained by an outer projection on the container, so that the tag is restrained from inadvertently falling into the container.

10 Claims, 6 Drawing Figures

RETENTION OF TAGS FOR FOOD AND BEVERAGE PREPARATION BAGS

This is a continuation-in-part of Ser. No. 957,760 filed Nov. 6, 1978, now abandoned.

BACKGROUND OF THE INVENTION

This invention relates to the retention of tags associated with food and beverage preparation bags, so that the tag will not enter the container in which the food or beverage is being prepared.

In the fast food preparation of beverages, soups and foodstuffs, ingredients such as tea leaves or food materials are placed in a bag to be steeped in a liquid such as hot water. The usual preparation bag is attached to an identification tag by a connecting element such as a string. The tag not only provides information about the item being prepared, it also permits sanitary manipulation of the bag by use of the tag alone.

Unfortunately, the tag often enters the container, for example, in the case of tea, when hot water is poured into a tea cup containing the tea bag.

Accordingly, it is an object of the invention to counteract the tendency for the tag of an associated bag to enter the container in which the item is being prepared. A related object is to restrict the tendency for the tags of tea bags to enter the tea cup or mup in which tea is being prepared.

SUMMARY OF THE INVENTION

In accomplishing the foregoing and related objects, the invention provides for retaining the tag of an associated preparation bag on an outer projection of the container in which the preparation is being made.

In accordance with one aspect of the invention the projection is positioned on the container near the upper rim thereof.

In accordance with another aspect of the invention, the projection is near and above any handle used with the container, and the projection and handle are proportioned to capture the tag. For the purpose the projection is desirably curved towards the upper part of the handle and is shorter than the width of the handle. The upper part of the handle is desirably planar at an angle of between fifteen and forty-five degrees, preferably thirty degrees with respect to the supporting base of the container.

In accordance with a further aspect of the invention, an opening is provided between the projection and the handle that is sufficiently wide for the connector or string connecting the bag to its associated tag, but narrower than the tag itself.

DESCRIPTION OF THE DRAWINGS

Other aspects of the invention will become apparent after considering several illustrative embodiments, taken in conjunction with the drawings in which.

DETAILED DESCRIPTION

Figure 1:
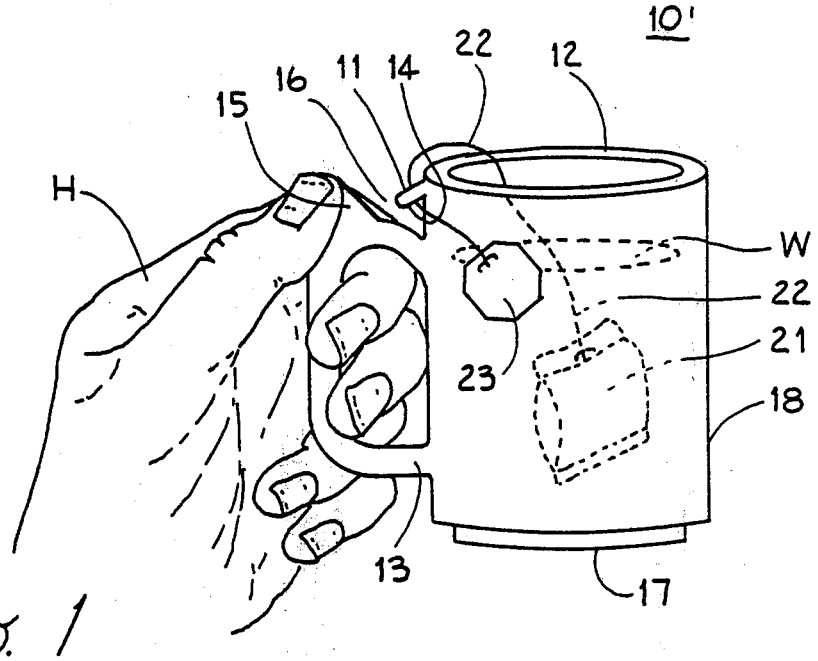
FIG. 1 is a perspective view of a tag retainer cup being used in accordance with the invention.

Turning to the drawings a tag retainer cup 10 being used in accordance with the invention is shown in FIG. 1. The cup 10 includes a projecting lip 11 positioned at the upper rim 12 of the cup 10 above a handle 13. The lip 11 desirably projects downwardly towards the handle 13 as shown, and is at the same axial position as the handle 13.

As depicted by FIG. 1, the tag retainer cup 10 is used by placing a preparation bag, such as a tea bag 21, into the bowl, i.e., inner portion, of the cup 10. The connector or string 22 that links the bag 21 with an identification and handling tag 23 is initially seated against the curved inner edge 14 of the projection 11.

In addition, the upper edge 15 of the handle 13 is proportioned to facilitate the seating of the string 22. In particular, the upper edge 15 is straight, i.e. planar, at an angle of elevation of between fifteen (15) and forty-five (45) degrees with respect to the plane of the container base 17. The preferred angle for the upper edge 15 is thirty (30) degrees. In addition the gap 16 between the edge 15 and the projection is wider than the string 22, but narrower than the edge dimensions of the tag 23, taken with respect to the face of the tag.

When a liquid, such as hot water W, is poured into the cup 10, the engagement of the string 22 with the projection 11 prevents the tag from being drawn into the container 10, as could otherwise be the case. In addition the placement of the retention projection 11 by the handle 13 limits the extent to which the retained tag can interfere with the hand H of the user.

Figure 2:
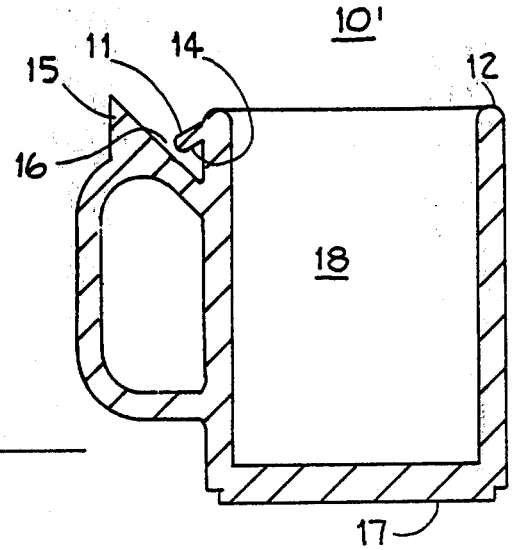
FIG. 2 is a cross sectional view of a tag retainer cup similar to that of FIG. 1.
Figure 3:
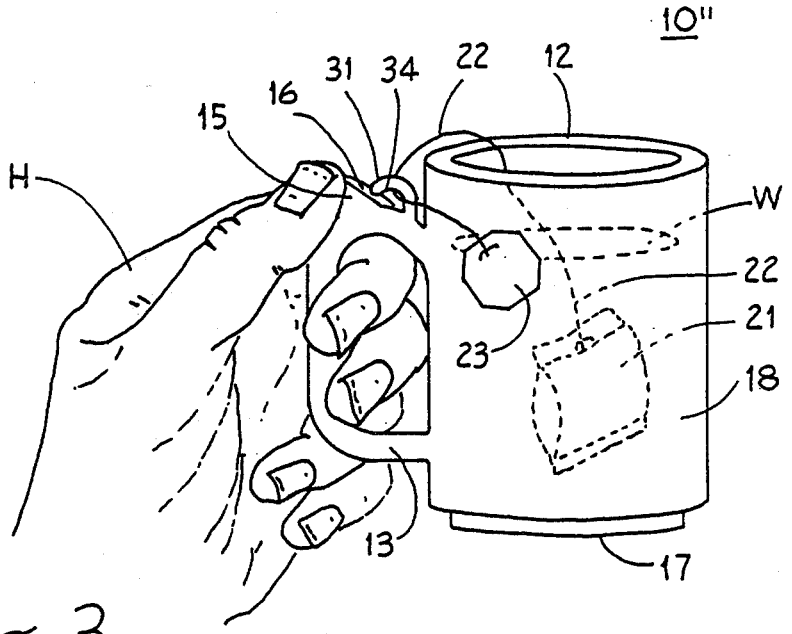
FIG. 3 is a perspective view of an alternative tag retainer cup in accordance with the invention.

Structural details of a cup 10', similar to that of FIG. 1, are shown in the cross sectional view of FIG. 2.

Figure 4:
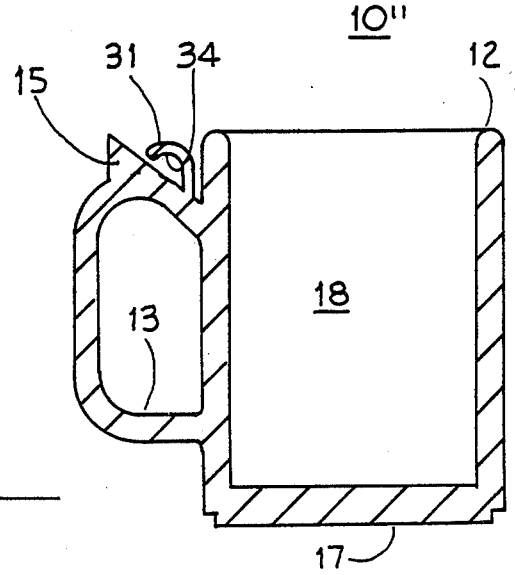
FIG. 4 is a cross sectional view of the tag retainer cup of FIG. 3.

An alternative embodiment is shown in FIG. 2, where a hook-like projection 31 with an inner retention surface 34 is included with the handle 13 of a cup 10''. Cross sectional details are shown in FIG. 4.

Figure 5:
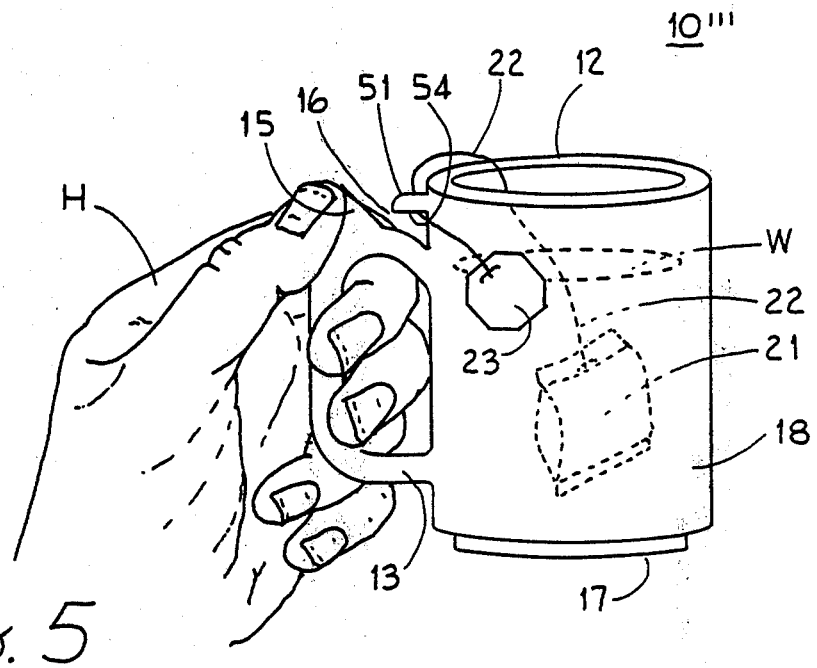
FIG. 5 is a perspective view of another alternative tag retainer cup in accordance with the invention.
Figure 6:
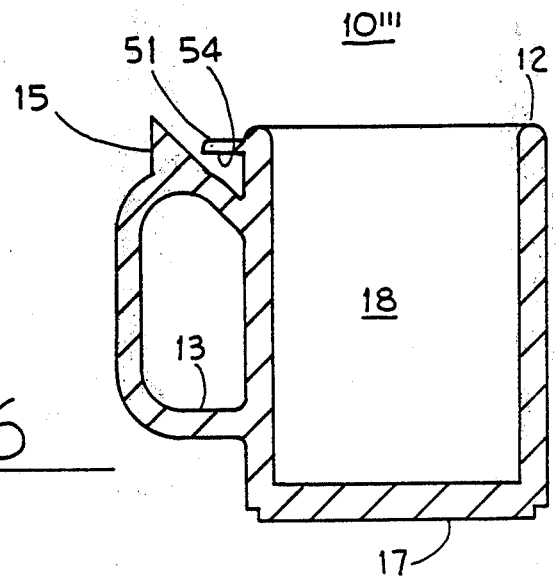
FIG. 6 is a cross sectional view of the cup of FIG. 5.

Another embodiment of the invention is shown in FIG. 5, where a hook-like projection 51 with a tag retention inner surface 54 extends directly outward from the outer wall 19 of the bowl portion 18 of a cup 10'''. Cross sectional details are shown in FIG. 6.

While various aspects of the invention have been set forth by the drawings and specification, it is to be understood that the foregoing detailed description is for illustration only and that various changes in parts, as well as the substitution of equivalent constituents for those shown and described may be made without departing from the spirit and scope of the invention as set forth in the appended claims.

What is claimed is:

1. A tag retention container, comprising a bowl having a base, an upper outer rim, and an affixed handle;

said handle having an upwardly and outwardly inclined upper surface; and a separate hook-like member projecting outwardly from said bowl adjoining the upper rim and facing and spaced from the upwardly inclined surface of said handle.

2. A tag retention container in accordance with claim 1 wherein said projecting member extends from said upper, outer rim.

3. A tag retention container in accordance with claim 1 wherein said member projects downwardly from its position of affixation on said bowl portion.

4. A tag retention container in accordance with claim 3 wherein said member has a curved lower surface.

5. A tag retention container in accordance with claim 1 wherein said container handle coacts with said projecting member to retain said tag.

6. A tag retention container in accordance with claim 5 wherein said handle and said projecting member are co-planar.

7. A tag retention container in accordance with claim 6 wherein said projecting member is spaced from said handle by an amount greater than the maximum thickness of the string connecting said tag to said bag position within said container, and less than the minimum edge dimension of the face of said tag.

8. A tag retention container in accordance with claim 7 wherein the upper edge of said handle opposite said projecting member is planar.

9. A tag retention container in accordance with claim 8 wherein said edge is at an angle of elevation in the range between 15 and 45 degrees with respect to the base of said container.

10. A tag retention container in accordance with claim 9 wherein said angle of elevation is thirty degrees.

* * * * *